US005875694A

United States Patent [19]

Graf

[11] Patent Number: 5,875,694

[45] Date of Patent: Mar. 2, 1999

[54] GOLF SPIKE TOOL

[76] Inventor: Raymond J. Graf, 4335 Riverside Dr., Crystal Lake, Ill. 60014

[21] Appl. No.: 842,433

[22] Filed: Apr. 24, 1997

Related U.S. Application Data

[63] Continuation-in-part of Ser. No. 580,503, Dec. 28, 1995, abandoned.

[51] Int. Cl.[6] ..... B25B 23/00

[52] U.S. Cl. ..... 81/461; 81/176.15

[58] Field of Search ..... 81/460, 461, 176.1, 81/176.15, 176.2

[56] References Cited

U.S. PATENT DOCUMENTS

| | | | |
|---|---|---|---|
| 3,134,292 | 5/1964 | Walton | 81/461 X |
| 3,302,672 | 2/1967 | Walton | 81/461 |
| 4,307,632 | 12/1981 | Penner | 81/63 |
| 4,480,514 | 11/1984 | Ponziani | 81/461 |

*Primary Examiner*—D. S. Meislin

*Attorney, Agent, or Firm*—Rudnick & Wolfe; James P. Ryther

[57] ABSTRACT

A tool for use in the installation and removal of golf spikes from the sole of a golf shoe. The golf spikes are of the type made of plastic and having a ground-engaging surface. Projections are formed on this surface, defining a variety of patterns such as a spiral pattern consisting of a plurality of curvilinear ridge portions extending radially outwardly from the center of the spike to the outer edge thereof. A plurality of rills are formed in the spike surface with a rill located between each pair of adjacent ridge portions. The tool comprises a head portion and a concave recessed surface defined by the head portion for engagement with the ground engaging surface of the spike. The recessed surface of the tool defines a plurality of spaced-apart projections dimensioned to be received within the spike rills, and a plurality of curvilinear recesses with each recess being located between each pair of adjacent projections. Each recess is dimensioned to receive one of the spike ridges. Upon rotation of the tool, a spike may be installed in or removed from a golf shoe. Alternatively, a tool having two sets of projections extending from the periphery of the tool is employed. Both types of projections, which are in alternating positions, extend short of the tool center and one set is shorter than the other whereby use with a large variety of plastic spike designs is possible.

19 Claims, 4 Drawing Sheets

60

GOLF SPIKE TOOL

This application is a continuation-in-part of application Ser. No. 08/580,503 filed on Dec. 28, 1995, abandoned.

BACKGROUND OF THE INVENTION

This invention relates to a tool for use in attaching golf spikes to golf shoes. In particular, the tool is useful for attaching spikes known as "soft" spikes.

Golf shoes require spikes or some other means for maintaining stability of the shoes relative to the ground during the golf swing. For many years, the great majority of golf shoe soles have been provided with threaded recesses positioned for attaching a plurality of spikes to the shoes. Such spikes have been mostly metal spikes consisting of a circular base having a narrow, ground-penetrating projection on one side and a threaded stud extending from the other side.

In order to tightly secure the threaded stud portion of a spike in a recess, a tool is needed. For engagement of the tool, a pair of holes are formed in the base of the spike on opposite sides of the projection. The spike tool or wrench includes pins which are receivable within these holes so that the spike can be rotated and eventually tightened relative to the shoe.

Although the metal spike and spike wrench design has been satisfactory from the standpoint of effectively attaching the spikes, the spikes have been criticized because of the tendency to damage putting greens. Thus, spike marks are formed on the putting surface due to penetration of the spikes, and this makes green maintenance more difficult. In addition, under the rules of golf, these marks cannot be repaired by the next golfers using the green until after they putt. Accordingly, spike marks have often been blamed for missed putts.

Other golf shoe designs were developed to deal with the problems of the metal spike. Such attempts included the formation of various tread designs for the bottom surface of golf shoes, however, problems remained with this approach. Thus, the treads did not prevent slipping during a golf swing and some designs also tended to damage greens.

Another innovation involves the use of "soft" spikes which, like metal spikes, have a central base and a threaded stud whereby they can be inserted in the same threaded recesses of a golf shoe sole. The spikes are molded from plastic, such as polyurethane, and the outer surfaces of these spikes have a spiral pattern molded therein. Such spikes have been found to provide the requisite stability for use by golfers, do not leave undesirable marks on greens, and do not create maintenance problems.

These "soft" spikes were usually designed with diametrically spaced holes to receive the pins of a spike wrench of the same type as used for attaching metal spikes. Such tools, which could be used manually or attached to a power drill, will rotate the spikes and thereby tighten the threaded studs of the spikes within the threaded shoe sole recesses.

The standard spike wrench is not, however, entirely suitable for use with the soft spikes. It has been found, for example, that the driving engagement of the tool and spike is less than satisfactory when a spike is being installed or removed leading to a time-consuming operation. This problem has been recognized in particular by individuals, such as locker room personnel at golf clubs, who have the responsibility for changing golfers' shoes from metal to plastic spikes, and who also must replace worn spikes from time to time.

Applicant's prior disclosure, Ser. No. 08/580,503, describes a novel tool design for use in place of the standard spike wrench. This tool was specifically designed for use in connection with a soft spike of the type defining a spiral pattern. Since that time, a wide variety of such spikes have been developed. Therefore, it has become desirable to utilize a more versatile tool adapted to accommodate most, if not all, designs in current use.

BRIEF DESCRIPTION OF THE INVENTION

This invention relates to a tool for use in the replacement of soft spikes for golf shoes. The invention particularly comprises a tool useful for individuals including locker room personnel at golfing establishments.

The tool may be used in the installation and removal of golf spikes relative to the sole of a golf shoe. The golf spikes may be of the type made of plastic and having a ground-engaging surface defining a spiral pattern consisting of a plurality of curvilinear ridge portions extending radially outwardly from the center of the spike to the outer edge thereof. In this type of spike, a plurality of rills are formed in the spike surface with a rill located between each pair of adjacent ridge portions.

The tool for this type of spike comprises a head portion and a concave recessed surface defined by the head portion for engagement with the ground engaging surface of the spike. The recessed surface defines a plurality of spaced-apart projections dimensioned to be received within the rills, and a plurality of curvilinear recesses, each recess being located between each pair of adjacent projections. Each recess is dimensioned to receive one of the ridges, and a handle or other means is employed for achieving rotation of the tool when the concave recessed surface thereof engages the ground-engaging surface of the spike.

A universal tool is also contemplated by the invention. Thus, new spike designs have taken a variety of forms including variations of the spiral design, use of a plurality of short, spike-like nibs, and use of spaced-apart, generally rectangular segments. A tool which will accommodate these various forms will facilitate the installation and removal of spikes since otherwise a different tool would be needed for each design encountered.

The universal tool of this invention consists of a recessed surface defining a plurality of spaced-apart projections. Each projection extends inwardly from the periphery of the tool surface to a location short of the center of the tool. The projections comprise a first set of shorter length and a second, alternating, set of greater length. Those of greater length are recessed adjacent the periphery of the tool.

DETAILED DESCRIPTION OF THE ILLUSTRATED EMBODIMENTS

1. The Prior Art

Figure 1:
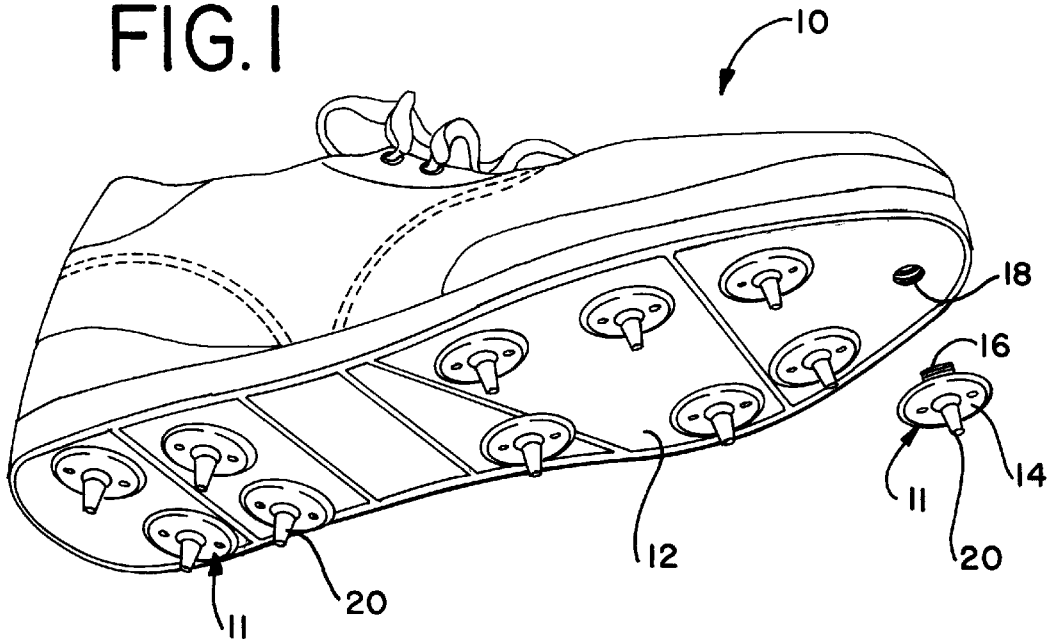
FIG. 1 is a perspective view of a golf shoe illustrating metal spikes attached to the sole.
Figure 2:
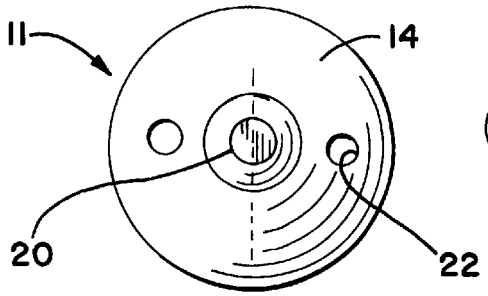
FIG. 2 is a plan view of a metal spike.
Figure 3:
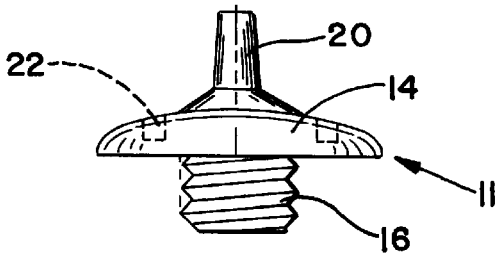
FIG. 3 is a side elevational view of a metal spike.

FIGS. 1–3 illustrate a golf shoe 10 having a sole 12 with metal spikes 11 attached thereto. The spikes define a base 14 and a threaded stud 16 receivable within threaded recess 18. A ground-penetrating projection 20 extends outwardly from the base.

Figure 4:
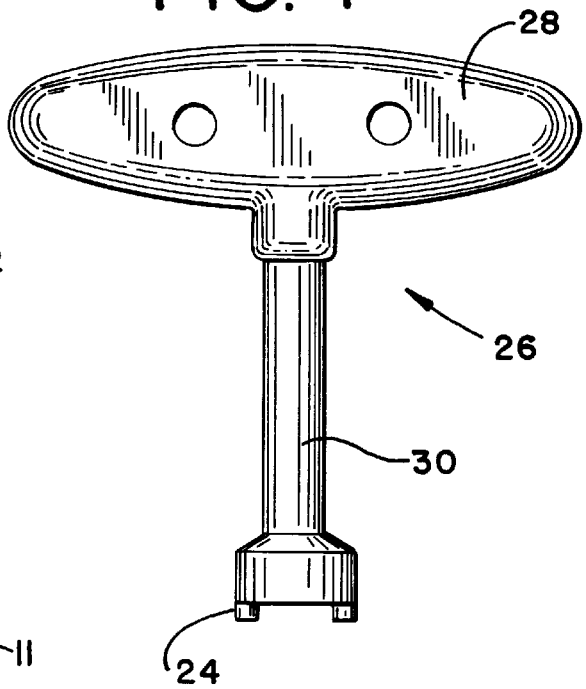
FIG. 4 is an elevational view of a spike wrench used for attaching metal spikes.

The base 14 defines spaced-apart holes 22 adapted to receive pins 24 carried by the spike wrench 26 shown in FIG. 4. The stem 30 of the wrench may support a handle 28 for manual turning or, with the handle removed, the wrench may be mounted on a power drill by means of stem 30. When the pins 24 are inserted in holes 22 and the tool rotated, the spikes may be tightened in the recesses 18 of the golf shoe sole, or removed from the shoe for replacement.

Figure 5:
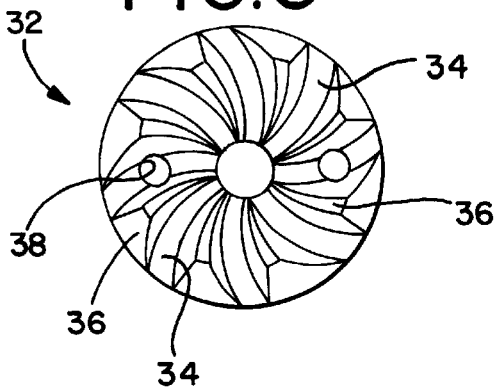
FIG. 5 is a plan view of a soft spike.
Figure 6:
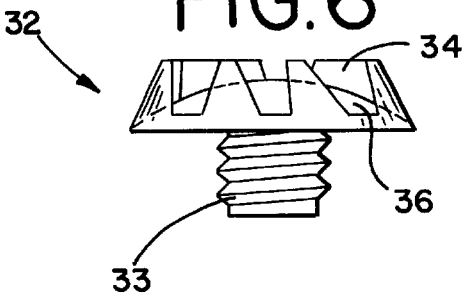
FIG. 6 is a side elevational view of a soft spike.

The golf spike 32 shown in FIGS. 5 and 6 also defines a threaded stud 33 for receipt within a threaded recess 18. The ground engaging surface of the spike defines a spiral pattern consisting of radially extending curved raised portions 34 with rills 36 formed therebetween. In addition, this surface of the spike defines holes 38 so that a spike wrench such as shown in FIG. 4 may be used for attaching and removing the spikes.

2. Description of the Preferred Embodiments

Figure 8:
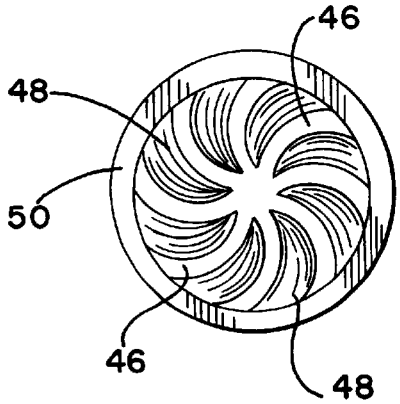
FIG. 8 is a bottom plan view of this tool.
Figure 7:
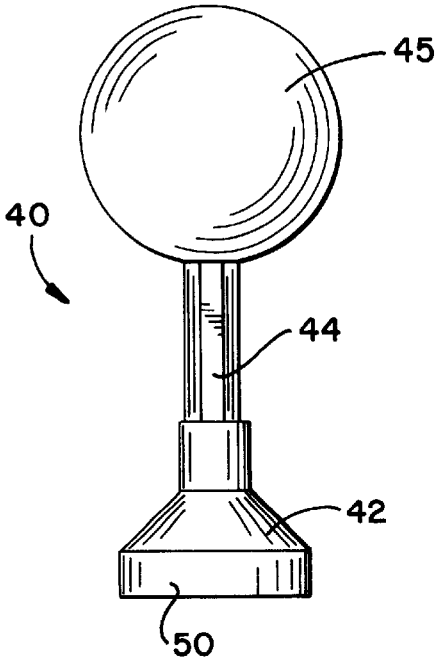
FIG. 7 is an elevational view of a tool in accordance with this invention.
Figure 9:
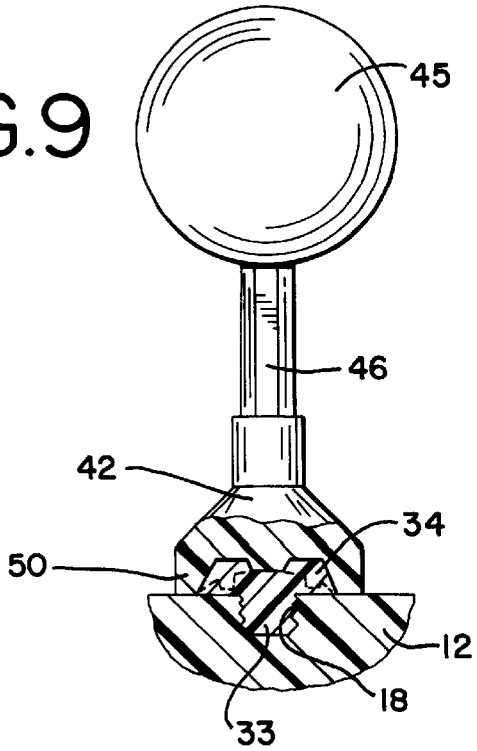
FIG. 9 is an elevational view of the tool and a spike engaged therewith, partly cut away.

FIGS. 7–9 illustrate one form of a tool 40 embodying this invention. The tool comprises head portion 42, a stem 44 attached thereto and a knob 45 serving as a handle to achieve manual rotation of the head. It will be appreciated that different forms for a handle may be employed. In addition, with the knob removed, the stem 44 may be used for attachment of a power drill. The head 42 may be molded from a durable plastic such as polyurethane, and stem 44 may comprise a steel member press-fit within a bore formed in the head during the molding operation.

The bottom side of the head 42 defines a concave recessed surface which is complementary to the outer surface of the soft spike. Thus, this surface of the tool has molded therein a plurality of curvilinear projections 46 extending radially from the center to the outer perimeter of the recessed area. A plurality of recesses 48 are defined between these projections. A skirt 50 is formed in surrounding relationship to the outer edges of the projections and recesses.

As best shown in FIG. 9, the projections 46 are dimensioned to interfit with respective ones of the rills 36 when the tool 40 is engaged with a soft spike 32. Similarly, the recesses 48 are dimensioned to interfit with respective ones of the rills 36 when the tool 40 is engaged with a soft spike 32. Similarly, the recesses 48 are dimensioned to receive raised portions 34 of the spike. When in this engaging relationship, the skirt 50 fits in surrounding relationship relative to the sides of the spike 32. Specifically, the dimensions of the recessed area of the tool 40 relative to the spike are such that the outer edge of the skirt will be substantially flush with the shoe sole surface when the tool is engaged with a spike threaded into a fully attached relationship with the sole.

Figure 10:
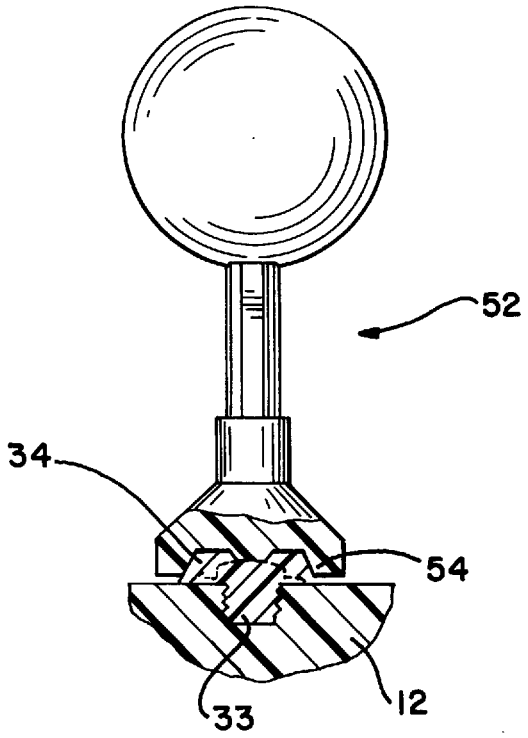
FIG. 10 is an elevational view of an alternative form of tool shown engaged with a spike.

FIG. 10 illustrates an alternative form of the invention wherein the tool 52 has a skirt 54 which is spaced inwardly relative to the outermost extent of the curvilinear linear projections 56 formed in the tool recess. This feature renders the tool more suitable for removing worn spikes since the tool can press into engagement with such a spike without interference from the shoe sole and there will be a better gripping relationship between the respective spike and tool surfaces.

Figure 11:
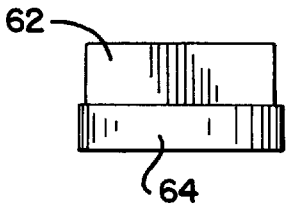
FIG. 11 is an elevational view of a still further tool design.
Figure 12:
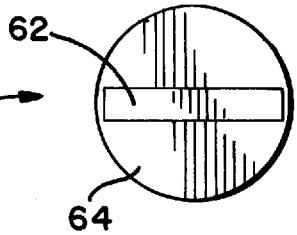
FIG. 12 is a plan view of the tool of FIG. 11.

FIGS. 11 and 12 illustrate a tool 60 having a rectangular handle 62 which extends completely across the top surface 64. The base 64 otherwise defines a recessed area as shown in FIG. 8 and functions in like manner. This provides a compact form of tool while permitting sufficient torque when manually engaged for achieving the attachment or removal of the spikes 32.

Figure 13:
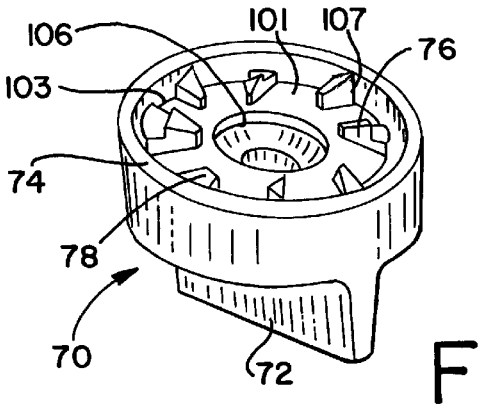
FIG. 13 is a perspective view of a universal tool characterized by the features of this invention.
Figure 14:
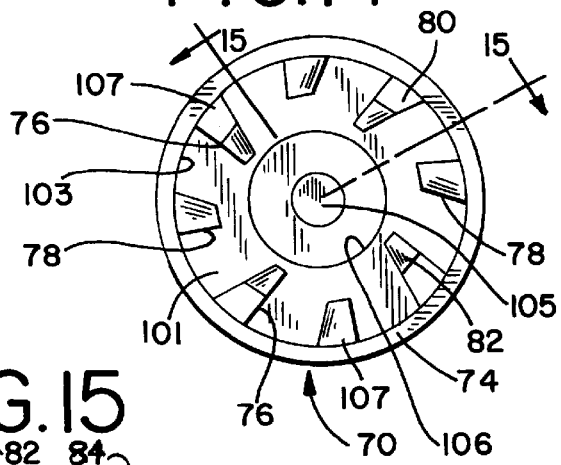
FIG. 14 is a plan view of the tool of FIG. 13.

FIGS. 13 and 14 illustrate another alternative form of the invention comprising a universal tool 70. This tool includes a handle 72 of the type shown in FIGS. 11 and 12 but it will be understood that this form of tool may utilize the other driving mechanisms illustrated.

The tool 70 comprises a skirt 74 surrounding a recessed area. A plurality of projections 76 and 78 have outer ends 107 located adjacent the skirt and these projections extend inwardly from the periphery with the longer projections 76 extending about one-half the distance toward the center, and the shorter projections 78 extending about one-third the distance to the center. The longer projections 78 extend outwardly a shorter distance than the projections 76 and the projections 78 define a recess 80 extending from the periphery of the tool about one-half the length of the projection 78.

Figure 15:
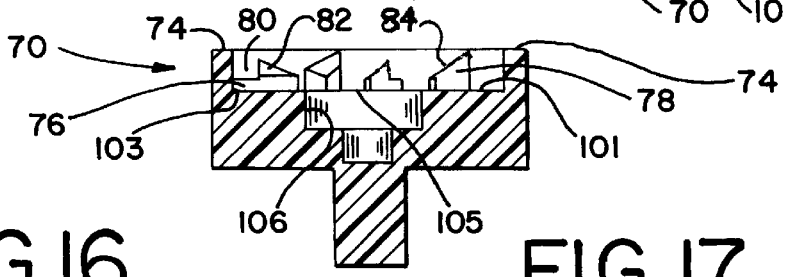
FIG. 15 is a vertical cross-sectional view of the tool of FIG. 13 taken about the line 15—15 of FIG. 14.

As shown particularly in FIGS. 13, 14 and 15, the spike-engaging projections extend longitudinally outwardly from the exposed transverse surface 101 defined by the tool. The projections extend from the outer periphery 103 of this surface toward the center 105 which is located at the rotational axis of the tool.

The upper surfaces of the projections are inclined or beveled. Specifically, the projections 76 define inclined outer surfaces 82 and the projections 78 define inclined outer surfaces 84. The inclines or bevels result in the formation of sharp leading edges on the projections when the tool is rotated counterclockwise for removal of spikes. This is especially helpful when the spikes are worn since the sharp edges will tend to dig into the spike surface for a better grip.

The outer projection faces are also inclined from the side wall toward the center as best shown in FIG. 15. This is to accommodate the central crown usually formed in a spike as shown in FIG. 6.

Figure 16:
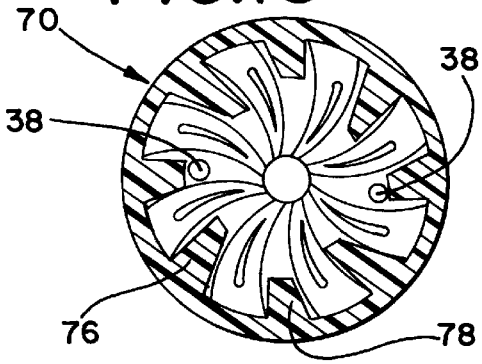
FIG. 16 is a cross-sectional view of the tool of FIG. 13 in engagement with a spiral-type cleat.

FIG. 16 illustrates engagement of the tool 70 with a spike having a spiral configuration of the type shown in FIG. 5. It will be noted that each of the projections 76 and 78 is received within the rills between the raised portions of this spike. Although the projections 76 and 78 are not as long as those of the tool 50, ample engagement is achieved and the tool will readily accomplish insertion and removal of this type of spike.

Figure 17:
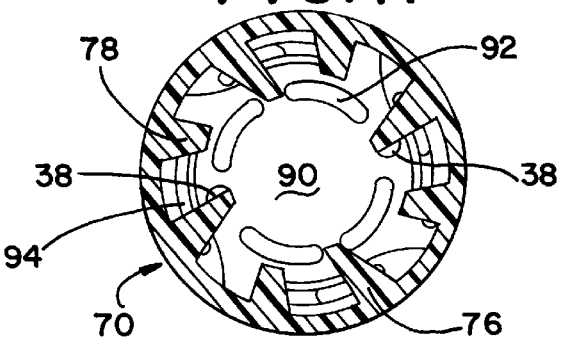
FIG. 17 is a cross-sectional view of the tool of FIG. 13 in engagement with a cleat having spaced-apart, generally rectangular, segments.

The spike 90 shown in FIG. 17 is a "Treadlite 2" version manufactured by Champion. In this instance, generally rectangular projections 92 are formed adjacent the center, and additional projections 94 are formed at the periphery. The latter are long and narrow and generally assume the curvature of the spike periphery. In addition, each of the projections 94 defines a recess 96.

The tool 70 effectively engages the spikes because the longer projections 76 of the tool extend between adjacent projections 92. At the same time, the shorter tool projections 78 extend between the outer projections 94 while the recesses 80 in the tool insure a close fit by avoiding interference with these outer projections.

Figure 18:
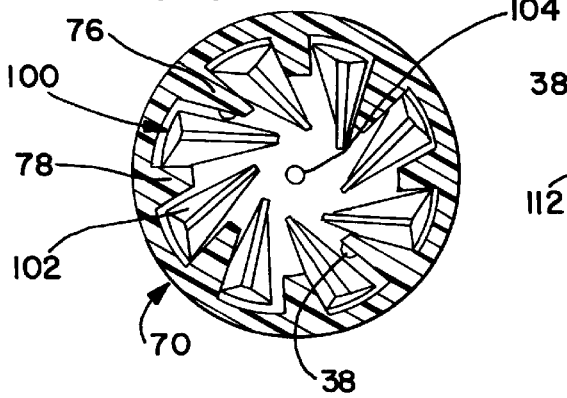
FIG. 18 is a cross-sectional view of the tool of FIG. 13 in engagement with a cleat having spaced-apart triangular segments; and, FIG. 19 is a cross-sectional view of the tool of FIG. 13 in engagement with a cleat having short projecting nibs.

The spike 100 of FIG. 18, a "Turfmate Plus" spike made by Footjoy, has projections 102 similar to those of the spiral spike. In addition, a centrally located metal projection 104 is employed, this latter projection extending outwardly farther than the projections 102. A well 106 is formed in tool 70 to accommodate the projection 104. Otherwise, adequate engagement is provided by projections 76 and 78 in the manner shown.

Figure 19:
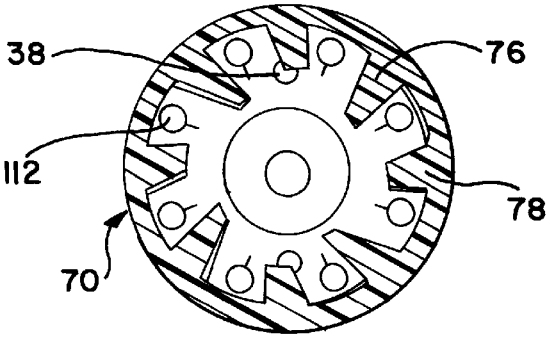

The spike 110 of FIG. 19 is an "Extra Performance" spike made by Softspike. Variations such as the Softspike "Extra Attraction" also include a plurality of spaced-apart nibs 112 for ground engagement.

As shown, the tool 70 readily receives the nibs between projections 76 and 78. Upon turning in either direction for insertion or removal, engagement between the nibs and projections is achieved. The skirt 74 may be of the longer or shorter variety as illustrated with respect to the tools 40 and 52.

The tools described operate in a significantly improved and more efficient manner when compared with a conventional tool of the type shown in FIG. 4. Thus, although the various soft spikes shown were all designed with openings 38 for use with a conventional tool, a completely adequate gripping relationship between the spikes and the tools of this invention is accomplished and the tool value is particularly improved when the universal tool of the invention is employed.

It will be understood that various changes and modifications of the tools of this invention may be made without departing from the spirit of this invention particularly as defined in the following claims.

That which is claimed is:

1. A golf spike installation and removal tool for use in the installation and removal of golf spikes from the sole of a golf shoe, said golf spikes being of the type made of plastic and having a ground-engaging surface defining a pattern consisting of ground-engaging projections extending outwardly, said tool comprising a head portion, a transverse surface defined by said head portion at one end thereof for engagement with said ground-engaging projections, said transverse surface having an outer periphery and a center, the rotational axis of said head portion extending through said center, said transverse surface supporting two sets of spaced-apart projections which extend longitudinally outwardly from said transverse surface, a first such set comprising elongated projections extending from said periphery of said transverse surface toward said center of said transverse surface, and a second such set comprising projections extending from said periphery of said transverse surface toward said center of said transverse surface, the projections of said second set alternating with the projections of said first set, and wherein the first set of projections extend longitudinally outwardly from the transverse surface a shorter distance than the second set of projections and in a direction of said rotational axis.

2. A tool according to claim 1 including a handle attached to said head on the opposite end thereof for achieving manual rotation of said tool.

3. A tool according to claim 1 including a stud attached to said head on the opposite end thereof for driving engagement of the tool with a power drill.

4. A tool according to claim 1 wherein said projections define outer ends positioned adjacent said periphery and wherein said head portion includes an integrally formed skirt portion located in surrounding relationship to the outer ends of said projections whereby a spike engaged with said tool is substantially enclosed by said skirt portion.

5. A tool according to claim 4 wherein the outer edge of said skirt portion is substantially engaged with the shoe sole surface when the spike engaged with the tool is in a fully attached relationship with the sole.

6. A tool according to claim 4 wherein the outer edge of said skirt portion is spaced upwardly relative to the outermost extent of said spaced-apart projections.

7. A tool according to claim 2 wherein said handle comprises a rectangular projection from said head portion, the projection extending outwardly to permit gripping with the fingers and extending laterally over substantially the entire lateral extent of the head portion.

8. A golf spike installation and removal tool for use in the installation and removal of golf spikes from the sole of a golf shoe, said golf spikes being of the type made of plastic and having a ground-engaging surface defining a pattern consisting of ground-engaging projections extending outwardly from the spike surface, said tool comprising a head portion, a concave recessed surface defined by said head portion for engagement with said ground-engaging projections, said recessed surface defining two sets of spaced-apart projections, a first such set comprising elongated projections extending from the periphery of said head portion inwardly toward the center of said recessed surface, and a second such set comprising shorter projections extending from said periphery of said head portion inwardly toward said center, the projections of said second set alternating with the projections of said first set, and including a recess formed in each of the projections of said first set adjacent said periphery.

9. A tool according to claim 8 including a well formed in said recessed surface at said center thereof.

10. A tool according to claim 8 wherein said first set of elongated projections extends about one-half the distance from said periphery toward said center, said second set of projections extends about one-third the distance from said periphery toward said center, and wherein the recesses in said first set extend about one-half the length of the projections of the first set, and wherein the first set of projections extend outwardly from the tool surface a shorter distance than the second set of projections.

11. A tool according to claim 8 wherein projections in said first and second sets define inclined upper surfaces, said surfaces defining sharp leading edges when the tool is turned for removal of spikes to enhance the gripping relationship of the tool with the spikes.

12. A tool according to claim 8 including a handle attached to said head for achieving manual rotation of said tool.

13. A tool according to claim 8 including a stud attached to said head for driving engagement of the tool with a power drill.

14. A tool according to claim 8 wherein said head includes a skirt portion located in surrounding relationship to the outer ends of said projections and recesses whereby a spike engaged with said tool is substantially enclosed by said skirt portion.

15. A tool according to claim 14 wherein the outer edge of said skirt portion is substantially engaged with the shoe sole surface when the spike engaged with the tool is in a fully attached relationship with the sole.

16. A tool according to claim 14 wherein the outer edge of said skirt portion is spaced upwardly relative to the outermost extent of said spaced-apart projections.

17. A tool according to claim 12 wherein said handle comprises a rectangular projection from said head portion, the projection extending outwardly to permit gripping with the fingers and extending laterally over substantially the entire lateral extent of the head portion.

18. A tool according to claim 4 wherein said first set of elongated projections extends at least about one-third the distance from said periphery toward said center.

19. A tool according to claim 18 wherein projections in said first and second sets define inclined upper surfaces, said surfaces defining sharp leading edges when the tool is turned for removal of spikes to enhance the gripping relationship of the tool with the spikes.

* * * * *